US011274506B2

(12) United States Patent
Willaman

(10) Patent No.: US 11,274,506 B2
(45) Date of Patent: Mar. 15, 2022

(54) DRILLING AND BOLTING DEVICE

(71) Applicant: Joy Global Underground Mining LLC, Warrendale, PA (US)

(72) Inventor: Patrick Ross Willaman, Utica, PA (US)

(73) Assignee: JOY GLOBAL UNDERGROUND MINING LLC, Warrendale, PA (US)

( * ) Notice: Subject to any disclaimer, the term of this patent is extended or adjusted under 35 U.S.C. 154(b) by 217 days.

(21) Appl. No.: 16/432,639

(22) Filed: Jun. 5, 2019

(65) Prior Publication Data

US 2019/0368282 A1 Dec. 5, 2019

Related U.S. Application Data

(60) Provisional application No. 62/680,696, filed on Jun. 5, 2018.

(51) Int. Cl.

| | |
|---|---|
| ***E21B 19/084*** | (2006.01) |
| ***E21D 20/00*** | (2006.01) |
| ***E21B 7/02*** | (2006.01) |

(52) U.S. Cl.

CPC ..... *E21B 19/084* (2013.01); *E21B 7/027* (2013.01); *E21D 20/003* (2013.01)

(58) Field of Classification Search

CPC ..... E21D 20/003; E21B 19/086; E21B 7/027; E21B 19/084

See application file for complete search history.

(56) References Cited

U.S. PATENT DOCUMENTS

| | | | | |
|---|---|---|---|---|
| 4,653,810 | A | 3/1987 | Adam | |
| 6,105,684 | A * | 8/2000 | Pointer | E21D 20/003 173/27 |
| 6,796,388 | B2 * | 9/2004 | O'Meley | E21D 20/003 173/11 |
| 9,664,041 | B2 * | 5/2017 | Jones | E21B 11/00 |

(Continued)

FOREIGN PATENT DOCUMENTS

| | | |
|---|---|---|
| CN | 201228555 Y | 4/2009 |
| EP | 2924236 A1 | 9/2015 |

(Continued)

OTHER PUBLICATIONS

Polish Patent Office Search Report for Application No. P-430137 dated Nov. 15, 2019 (3 pages including statement of relevance).

(Continued)

*Primary Examiner* — Carib A Oquendo
(74) *Attorney, Agent, or Firm* — Michael Best & Friedrich LLP

(57) ABSTRACT

A drill device includes a base frame, a feed frame supported for movement relative to the base frame, and a feed device for inserting a drill element into a rock surface. The base frame includes a pair of fluid cylinders. The feed frame extends along a feed axis and includes a plurality of guide bars aligned parallel to the feed axis. The feed device is supported for movement relative to the feed frame in a direction parallel to the feed axis. The feed device includes a first guide member and a second guide member. The first guide member engages a surface of at least one of the guide bars, and the second guide member engages another surface of at least one of the guide bars.

18 Claims, 11 Drawing Sheets

(56) References Cited

U.S. PATENT DOCUMENTS

| | | | | |
|---|---|---|---|---|
| 2007/0286707 | A1* | 12/2007 | Eddowes | E21B 19/20 414/22.51 |
| 2010/0266346 | A1* | 10/2010 | Eddowes | B65H 51/10 405/259.1 |
| 2017/0204666 | A1* | 7/2017 | Galler | E21B 7/027 |
| 2019/0360273 | A1* | 11/2019 | Thornton | B28D 1/041 |

FOREIGN PATENT DOCUMENTS

| | | | |
|---|---|---|---|
| PL | 211796 | B1 | 6/2012 |
| RU | 2307910 | C1 | 10/2007 |
| RU | 81525 | U1 | 3/2009 |
| RU | 168385 | U1 | 2/2017 |

OTHER PUBLICATIONS

Russian Patent Office Action for Application No. 2019117272/03 dated Dec. 20, 2021 (12 pages with English translation).

* cited by examiner

DRILLING AND BOLTING DEVICE

REFERENCE TO RELATED APPLICATION

This application claims the benefit of prior-filed, U.S. Provisional Patent Application No. 62/680,696, filed Jun. 5, 2018, the entire contents of which are incorporated by reference.

TECHNICAL FIELD

The present disclosure relates to drill devices, and particularly to a drilling and bolting device for forming a hole or inserting a bolt into a hole in a rock surface.

BACKGROUND

Conventional drilling and bolting rigs may include an extendable support frame and a drive unit movable along the frame. The drive unit drives a drill bit or bolt into a rock surface. The actuation of the drilling and bolting rig can be achieved using fluid power (e.g., hydraulic power).

SUMMARY

In one independent aspect, a drill device includes a base frame, a feed frame supported for movement relative to the base frame, and a feed device for inserting a drill element into a rock surface. The base frame includes a pair of fluid cylinders. The feed frame extends along a feed axis and includes a plurality of guide bars aligned parallel to the feed axis. The feed device is supported for movement relative to the feed frame in a direction parallel to the feed axis. The feed device includes a first guide member and a second guide member. The first guide member engages a surface of at least one of the guide bars, and the second guide member engages another surface of at least one of the guide bars.

In some aspects, the feed device includes a yoke movable relative to the feed frame and a carriage movable relative to the yoke and supporting a rotation unit, wherein the guide bars engage and guide both the yoke and the carriage.

In some aspects, the feed frame includes an upper feed block and a lower feed block between which the plurality of guide bars extend.

In some aspects, the plurality of guide bars includes a first pair of guide bars positioned on one side of the feed frame and a second pair of guide bars positioned on another side of the feed frame.

In some aspects, the yoke includes an upper plate and yoke actuators coupled between the upper plate and the lower feed block.

In some aspects, each of the guide bars has a polygonal cross-section profile.

In some aspects, each of the guide bars has a hexagonal cross-section profile.

In some aspects, the first guide member is an inner guide member, the inner guide member having a convex shape and including an apex positioned in a root that is formed by at least one of the guide bars, and wherein the second guide member is an outer guide member, the outer guide member having a concave shape and including a root receiving an edge of at least one of the guide bars.

In some aspects, the first guide member and the second guide member are positioned on opposite sides of the feed axis relative to one another, the first guide member having a convex shape and including a first apex positioned in a first root that is formed by at least one of the guide bars, the second guide member having a convex shape and including a second apex positioned in a second root that is formed by at least one of the guide bars.

In some aspects, the first guide member and the second guide member are positioned on opposite sides of the feed axis relative to one another, the first guide member having a concave shape and including a first root receiving a first edge of at least one of the guide bars, the second guide member having a concave shape and including a second root receiving a second edge of at least one of the guide bars.

In some aspects, the first guide member includes a pair of inner guide members positioned on opposite sides of the feed axis from one another, each of the inner guide members having a convex shape and including an apex positioned in a root that is formed by at least one of the guide bars. The second guide member includes a pair of outer guide members positioned on opposite sides of the feed axis from one another, each of the outer guide members having a concave shape and including a root receiving an edge of at least one of the associated guide bars. The apices of the inner guide members are positioned in a first plane and the roots of the outer guide members are positioned in a second plane offset from the first plane.

In another independent aspect, a drill device includes a base frame including a pair of fluid cylinders; a feed frame supported for movement relative to the base frame; and a feed device supported on the feed frame, the feed device including a yoke, a spindle supported on the yoke, and a flexible transmission member engaging the spindle, the spindle being releasably coupled to the yoke to permit at least one shim to be positioned between the spindle and the yoke, thereby adjusting a tension of the flexible transmission member.

In some aspects, the feed device further includes a carriage, and wherein a first end of the flexible transmission member is coupled to a block connected to the feed frame, and an opposite end of the flexible transmission member is coupled to the carriage.

In some aspects, the yoke includes a body supporting a drive member, and wherein the spindle includes a non-rotating portion that is coupled to the body of the yoke.

In yet another independent aspect, a drill device includes a base frame including a pair of fluid cylinders; a feed frame supported for movement relative to the base frame; and a feed actuator including a first end coupled to the base frame and a second end coupled to the feed frame, the feed actuator being extendable and retractable to move the feed frame relative to the base frame, the feed actuator having an identical height and width as the fluid cylinders of the base frame, the feed actuator positioned in an opposite orientation relative to the fluid cylinders of the base frame.

In some aspects, at least one of the feed actuator and the fluid cylinders includes a first passage for providing pressurized fluid to one side of a piston, a second passage for providing pressurized fluid to an opposite side of the piston, and a manifold receiving pressurized fluid from a fluid source, the manifold providing fluid to each of the first passage and the second passage.

In some aspects, at least one of the feed actuator and the fluid cylinders includes a first passage for providing pressurized fluid to one side of a piston, a second passage for providing pressurized fluid to an opposite side of the piston, and a manifold providing fluid communication between a first portion of the first passage and a second portion of the first passage.

In some aspects, the base frame includes a lower plate and a connecting plate between which the fluid cylinders extend.

In some aspects, the fluid cylinders each include a rod and a barrel, the rod including a proximal end and a distal end, the proximal end coupled to a piston slidably positioned within the barrel, the distal end secured to the connecting plate, the barrel secured to the lower block.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
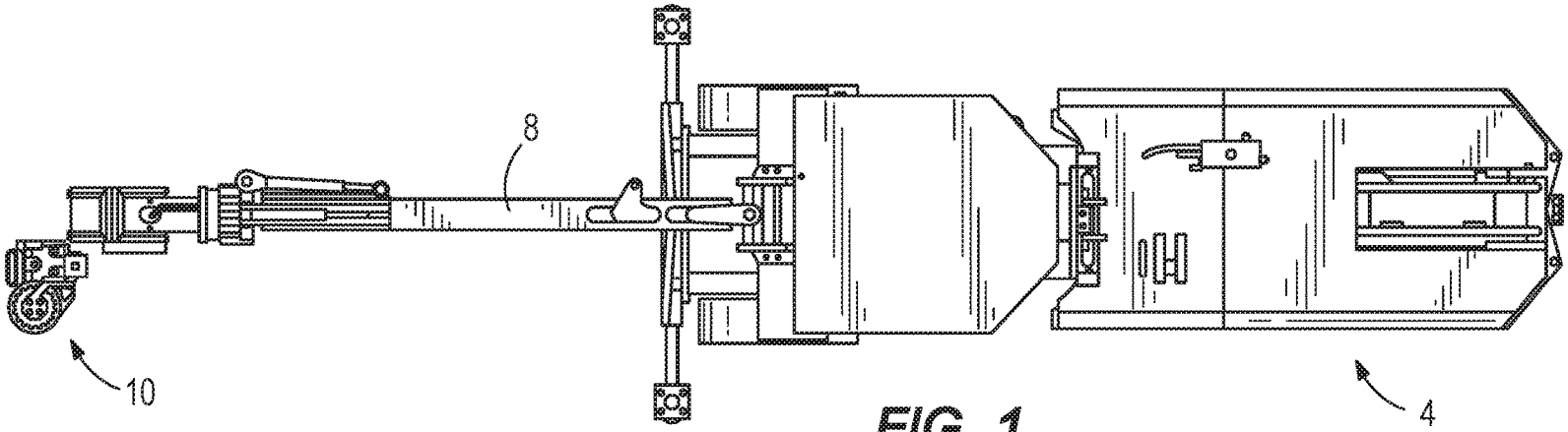
FIG. 1 is a plan view of a mobile machine including a drill device.
Figure 2:
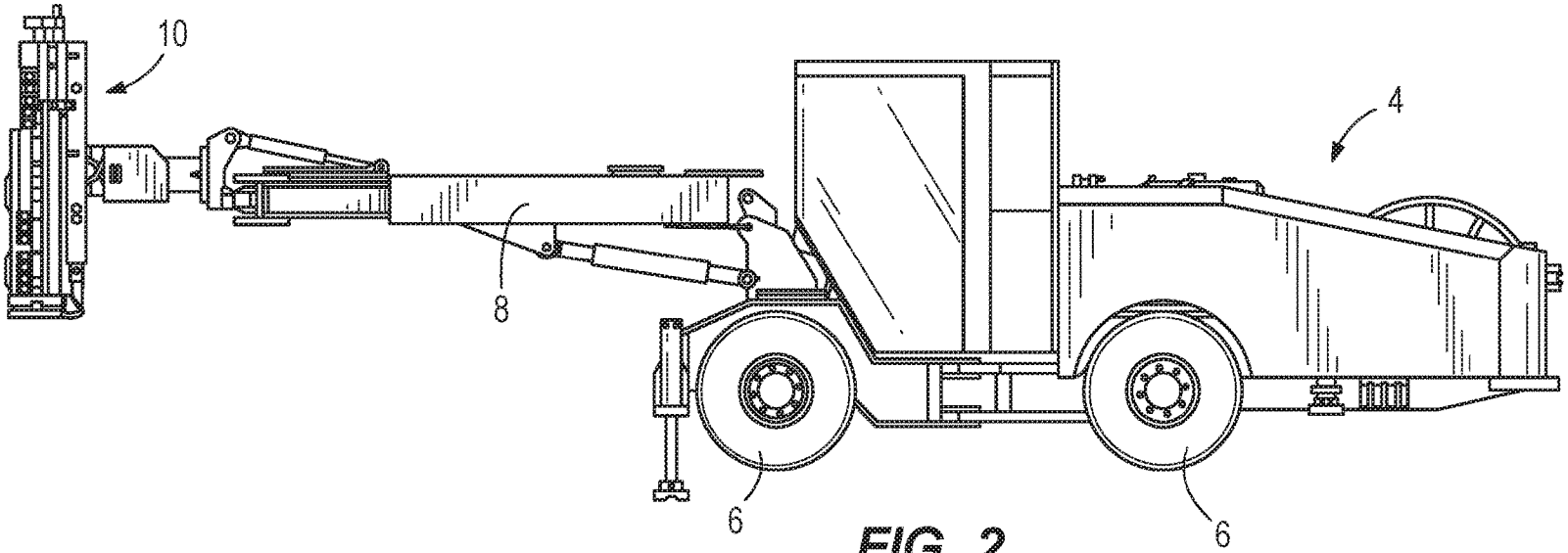
FIG. 2 is a side view of the mobile machine of FIG. 1.

FIGS. 1 and 2 illustrate a mobile mining machine, such as a bolting jumbo or bolting machine 4. In the illustrated embodiment, the machine 4 includes traction devices 6 (e.g., wheels—FIG. 2) and a boom 8. The boom 8 supports a drilling and bolting rig, or drill device 10, for forming holes in a mine surface (e.g., a roof, a floor, or a rib or side wall—not shown) and/or installing a drill element (e.g., a bit or a bolt—not shown). In the illustrated embodiment, the drill device 10 performs both drilling and bolting operations. In some embodiments, the boom 8 is extendable and includes a pivoting portion for supporting the drill device 10. Among other things, an installed bolt may anchor or support a safety mesh (not shown) to protect personnel against rock that may fall or become dislodged from the mine surface. In some embodiments, the drill device 10 may be mounted on another type of mining machine, such as a continuous mining machine (not shown).

Figure 3:
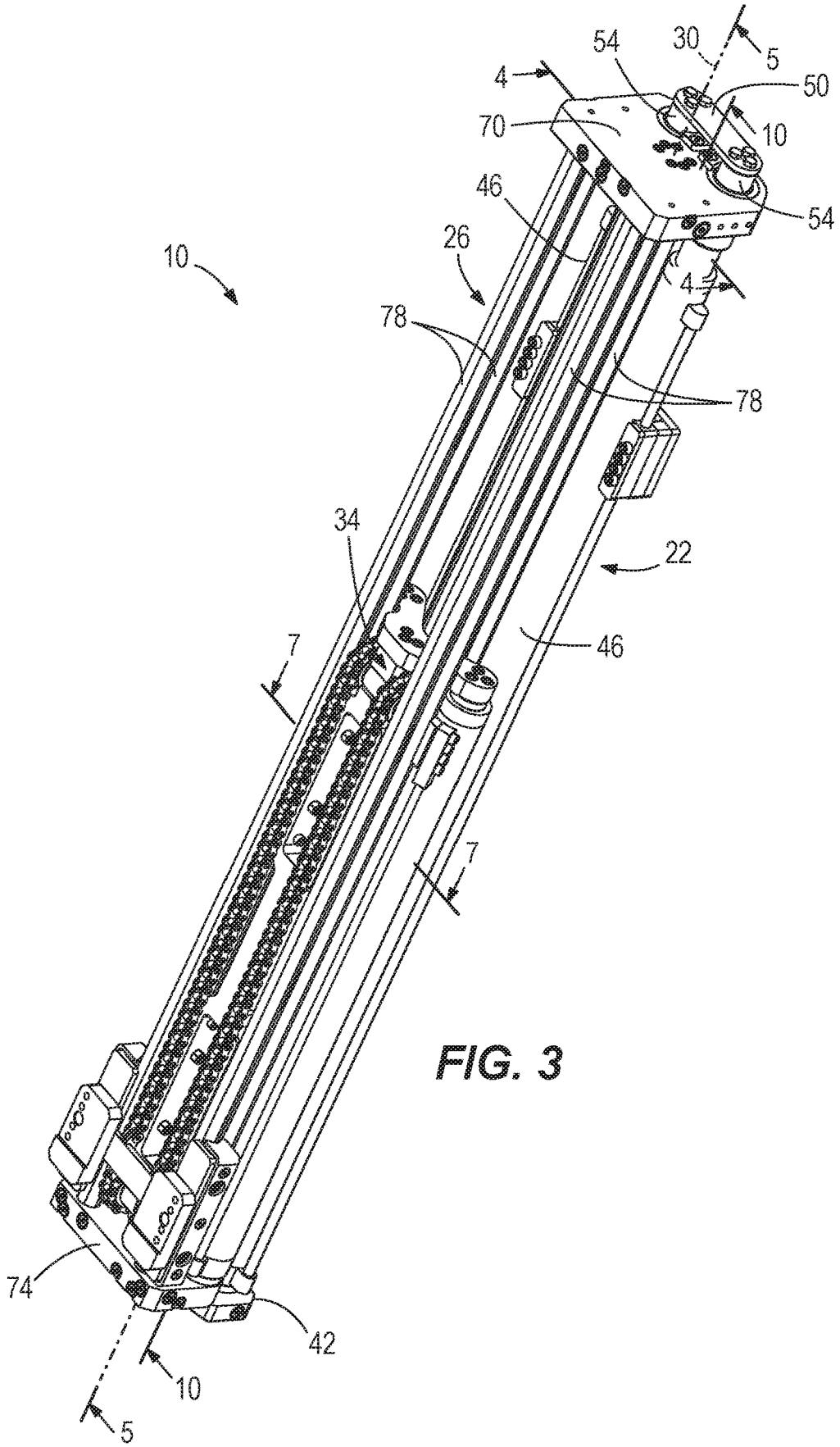
FIG. 3 is a perspective view of a drill device.

As shown in FIG. 3, the drill device 10 includes a first stage or timber jack or base frame 22 and a second stage or feed frame 26 supported on the base frame 22 for movement along a feed axis 30. A feed device 34 is supported on the feed frame 26 for movement parallel to the feed axis 30. The feed device 34 supports a drive unit or rotation unit (not shown) for rotating the bit or bolt as the feed device 34 moves along the feed frame 26 to drive the bit/bolt into a rock surface.

The base frame 22 includes a lower plate or lower block 42 positioned proximate a first end of the drill device 10 and a pair of elongated base members 46 oriented parallel to one another and extending away from the lower block 42. In other embodiments, the base frame 22 may include fewer or more base members. A connecting plate 50 is secured to a distal end of each base member 46. In some embodiments, the distal ends of the base members 46 may be secured to an upper plate or upper block (not shown), which may include an opening through which the bolt passes and/or a clamp or gripping device for aligning and/or gripping the bolt.

Figure 4:
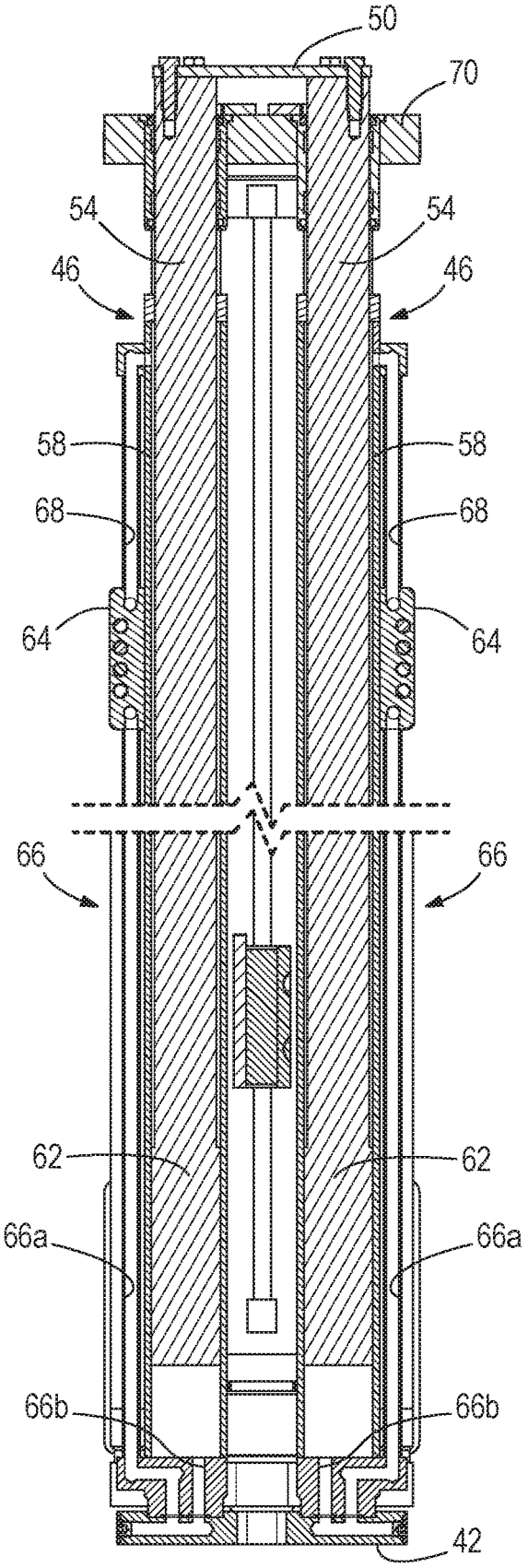
FIG. 4 is a section view of the drill device of FIG. 3, viewed along section 4-4.

As shown in FIG. 4, in the illustrated embodiment, the base members 46 are fluid cylinders and are extendable and retractable to move the distal ends of the base members 46 toward and away from the lower block 42. Each base member 46 includes a rod 54 slidably received within a sleeve or barrel 58 secured to the lower block 42. A proximal end of each rod 54 is coupled to a piston 62 positioned within the barrel 58, and a distal end of each rod 54 is secured to the connecting plate 50. A first fluid passage 66 is in fluid communication with a portion of the barrel 58 adjacent a cap side of the piston 62, and a second fluid passage 68 is in fluid communication with a portion of the barrel 58 adjacent a rod side of the piston 62. In the illustrated embodiment, the first fluid passage 66 and the second fluid passage 68 receive pressurized fluid through a manifold 64 in fluid communication with a fluid source (e.g., a pump—not shown). The first fluid passage 66 includes a first portion **66*a* extending between the manifold 64 and the lower block 42, and a second portion 66*b* provides communication between the lower block 42 and the barrel 58. In some embodiments, the manifold 64 provides fluid communication between the first fluid passage 66 and the second fluid passage 68**.

Referring again to FIG. 3, the feed frame 26 includes an upper feed block 70, a lower feed block 74, and guide bars 78 extending between the upper feed block 70 and the lower feed block 74. In the illustrated embodiment, the rods 54 of the base members 46 pass through the upper feed block 70. In some embodiments, the upper feed block can include an opening (not shown) through which the bolt passes, as well as a clamp or gripping device (not shown) for aligning and/or gripping the bolt during insertion into the rock surface.

Figure 5:
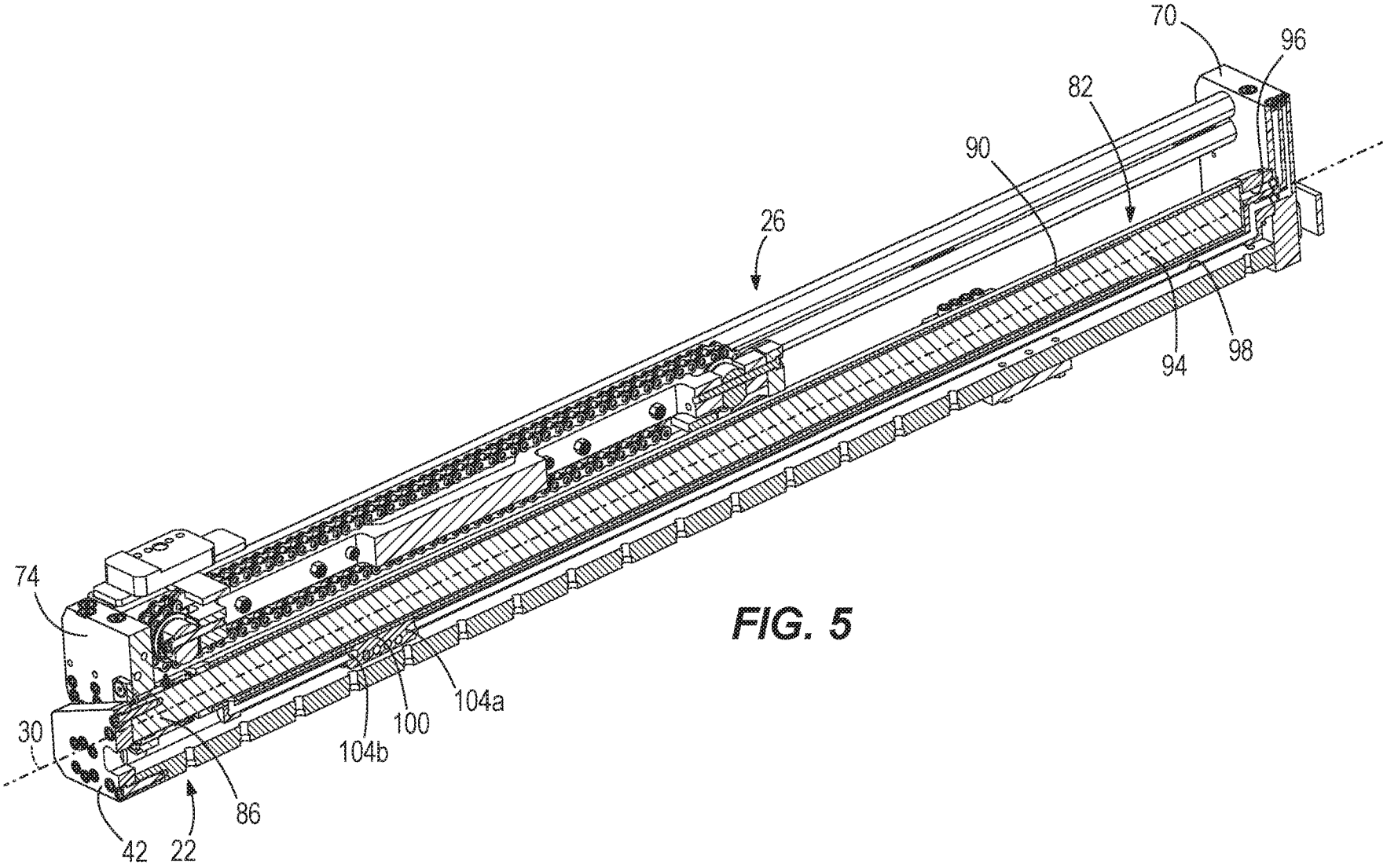
FIG. 5 is a section view of the drill device of FIG. 3, viewed along section 5-5.

As shown in FIG. 5, a feed frame actuator 82 is coupled between the base frame 22 and the feed frame 26 to move the feed frame 26 along the feed axis 30. The feed frame actuator 82 is a fluid cylinder such that extension and retraction of the feed frame actuator 82 moves the feed frame 26 along the base members 46 (FIG. 3). The feed frame actuator 82 includes a rod 86 slidably received within a sleeve or barrel 90 secured to the upper feed block 70. A proximal end of the rod 86 is coupled to a piston 94 positioned within the barrel 90, and a distal end of the rod 86 is secured to the lower block 42 of the base frame 22. In the illustrated embodiment, the rod 86 of the feed frame actuator 82 passes through the lower feed block 74. The feed frame actuator 82 is oriented anti-parallel relative to the base members 46 (i.e., the rod 86 of the feed frame actuator 82 extends from the barrel 90 in an opposite direction compared to the rods 54 of the base members 46). Extension and retraction of the feed frame actuator 82 moves the feed frame in a direction parallel to the feed axis 30. When the base members 46 are fully extended, full extension of the feed frame actuator 82 positions the upper feed block 70 proximate the distal ends of the base members 46.

In the illustrated embodiment, the feed frame actuator 82 is identical to the base members 46 but is positioned in an opposite orientation. The feed frame actuator 82 includes a first fluid passage 96 in fluid communication with a portion of the barrel 90 adjacent a cap side of the piston 94, and a second fluid passage 98 in fluid communication with a portion of the barrel 90 adjacent a rod side of the piston 94. In the illustrated embodiment, the first fluid passage 96 of the actuator is in fluid communication with the barrel 90 adjacent the upper feed block 70, and the second fluid passage 98 extends along a length of the barrel 90 and is in fluid communication with an opposite end of the barrel 90. The second fluid passage 98 passes through a manifold 100 including ports 104*a*, 104*b* that are fluidly connected to one another in series to permit fluid to pass through the manifold 100. Both the first fluid passage 96 and the second fluid passage 98 of the feed frame actuator 82 receive pressurized fluid through the upper feed block 70. In other embodiments, the first fluid passage 96 and the second fluid passage 98 of the feed frame actuator 82 may receive pressurized fluid through the manifold 100, and the manifold additionally may provide fluid communication between the first fluid passage 96 and the second fluid passage 98.

Figure 6:
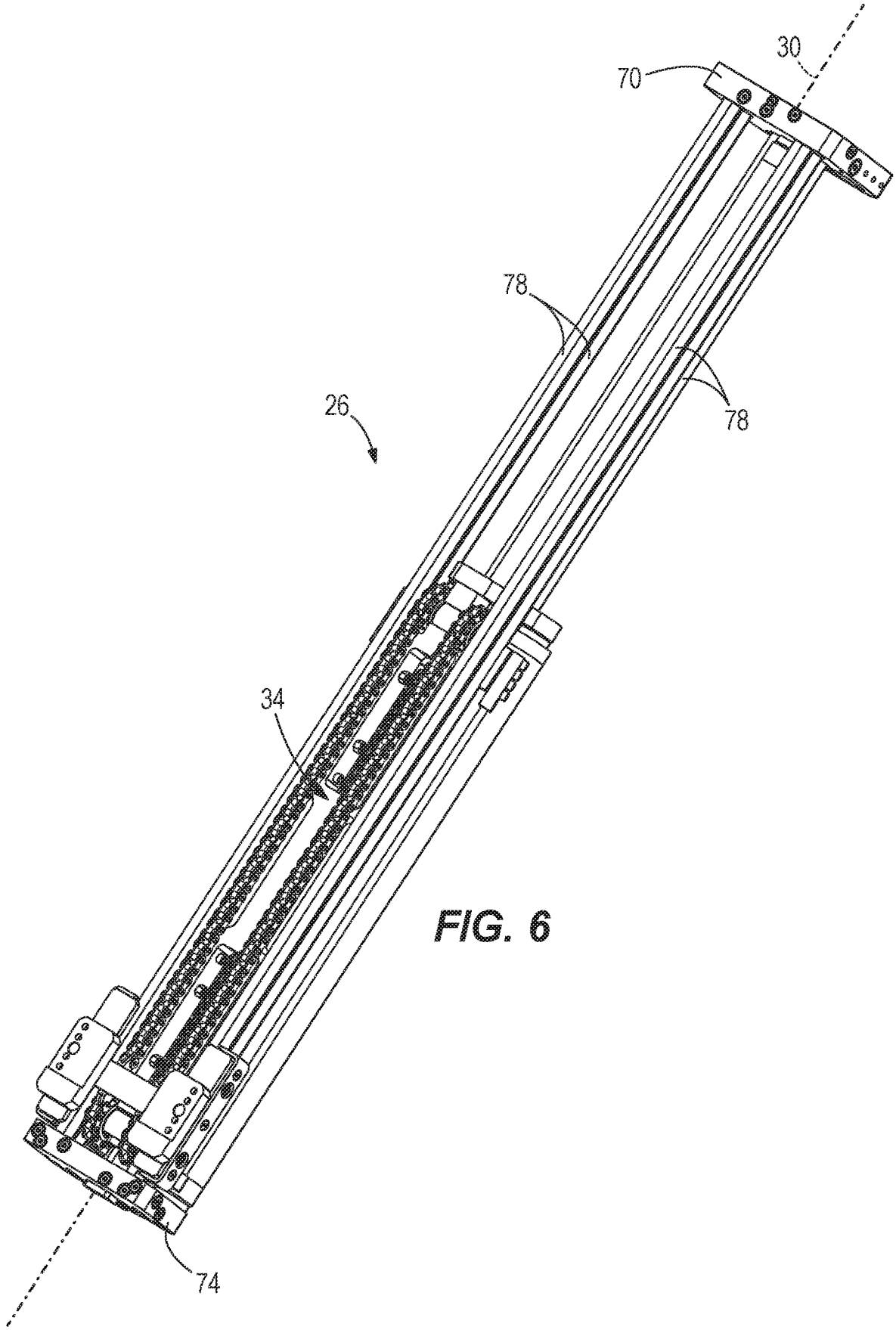
FIG. 6 is a side view of a feed frame.
Figure 7:
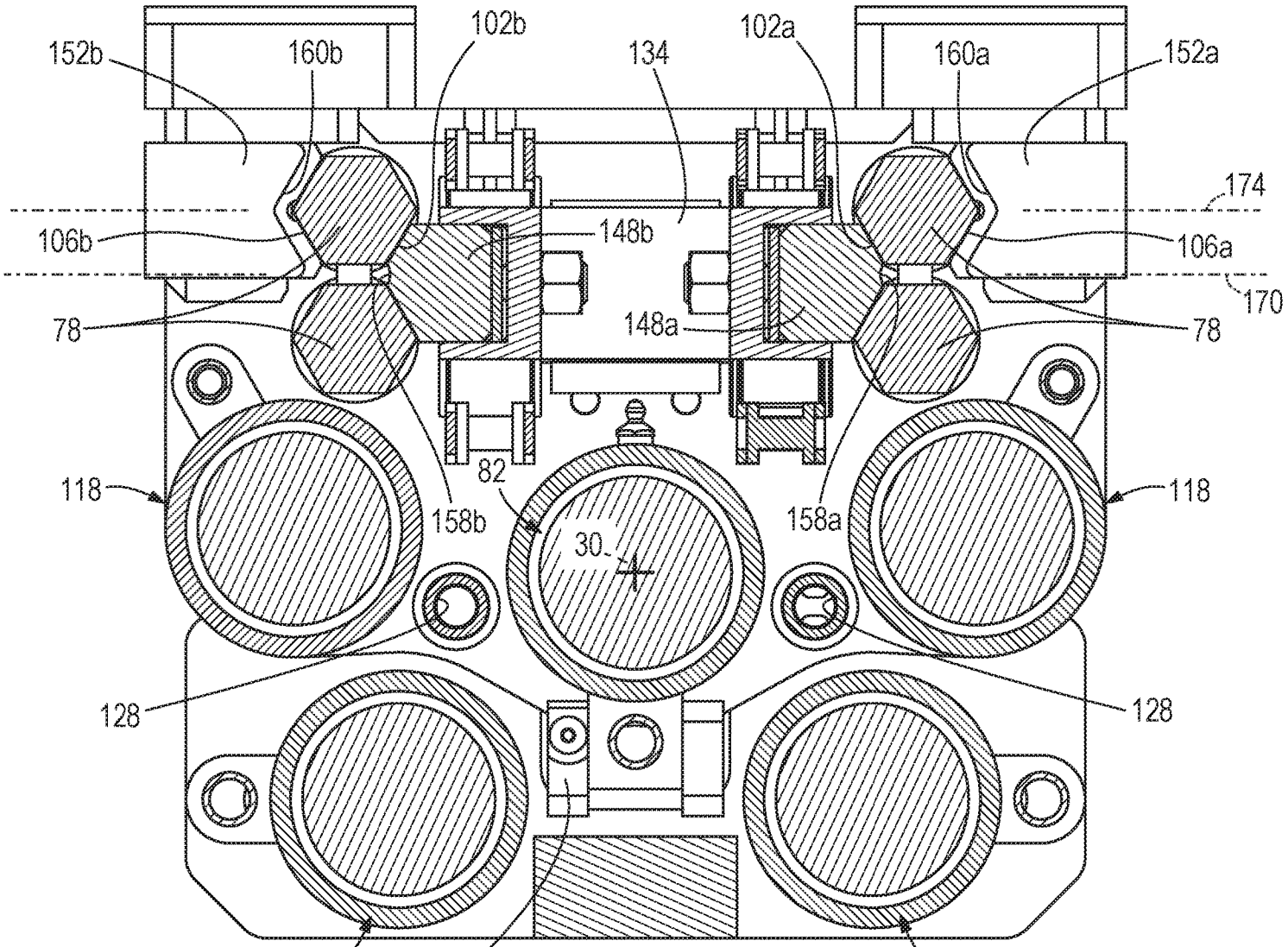
FIG. 7 is a section view of the drill device of FIG. 3, viewed along section 7-7.

Referring now to FIGS. 6 and 7, each of the guide bars 78 is oriented parallel to the feed axis 30 and has a polygonal cross-section profile. In the illustrated embodiment, the polygonal cross-section profile is hexagonal; in other embodiments, the profile may have another shape. In the illustrated embodiment, the guide bars 78 are positioned in pairs on each side of the feed frame 26, extending between the lower feed block 74 and the upper feed block 70. As shown in FIG. 7, a surface of each guide bar 78 faces a parallel side of the associated guide bar 78 in the pair. Accordingly, each pair of guide bars 78 forms an inner groove 102*a*, 102*b* opening toward the feed axis 30, and each pair of guide bars 78 forms an outer groove 106*a*, 106*b* opening away from the feed axis 30.

Figure 8:
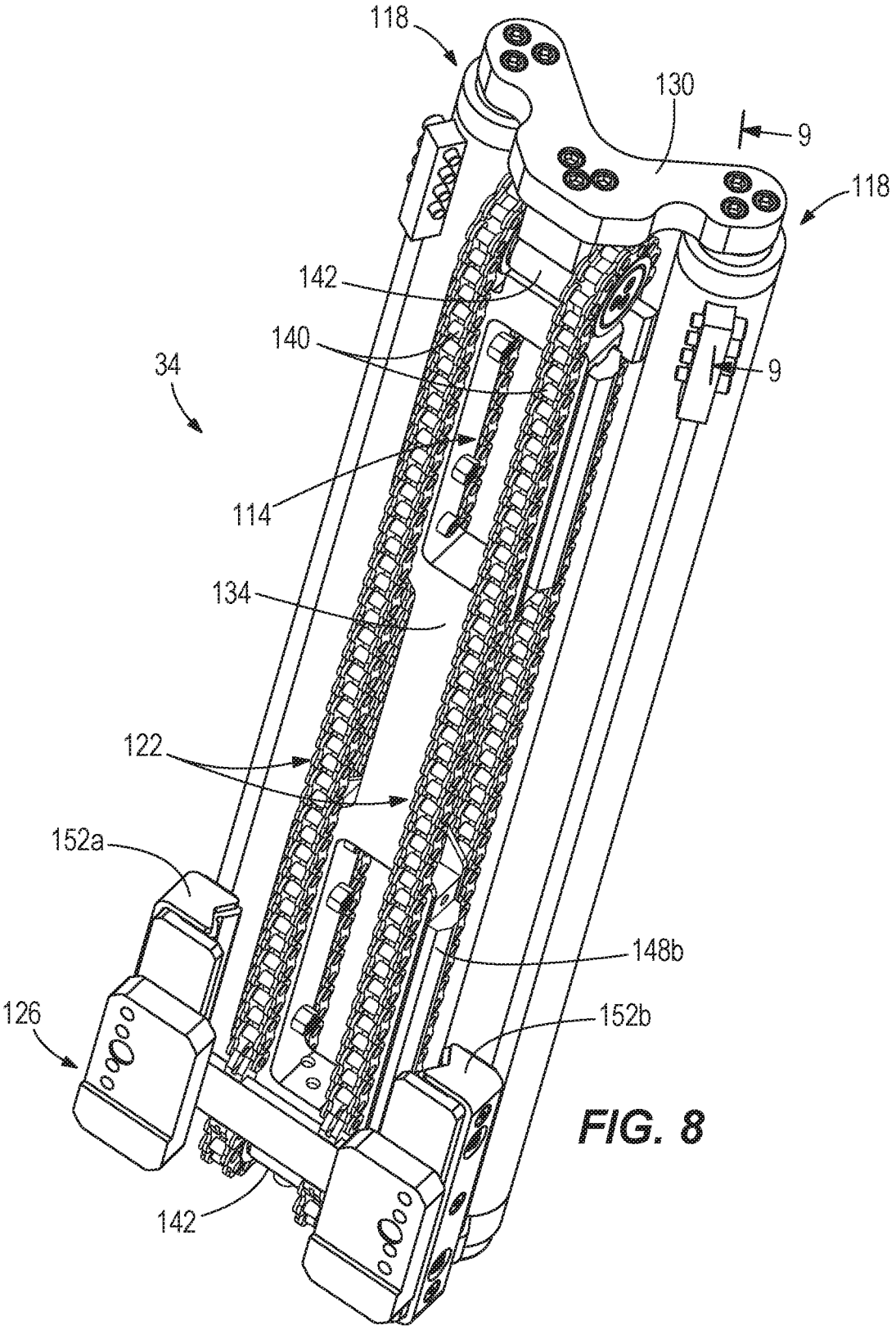
FIG. 8 is a perspective view of a feed device.

As shown in FIG. 8, the feed device 34 supports the rotation unit (not shown). The feed device 34 includes a yoke 114, a pair of yoke actuators 118, a drive member 122, and a carriage 126 supporting the rotation unit (not shown). The yoke 114 includes an upper plate 130 and a body 134 supporting the drive member 122. The yoke actuators 118 are coupled between the upper plate 130 and the lower feed block 74 (FIG. 6). In the illustrated embodiment, each yoke actuator 118 is a fluid cylinder such that extension and retraction of the yoke actuator 118 moves the upper plate 130 relative to the lower feed block 74.

Figure 9:
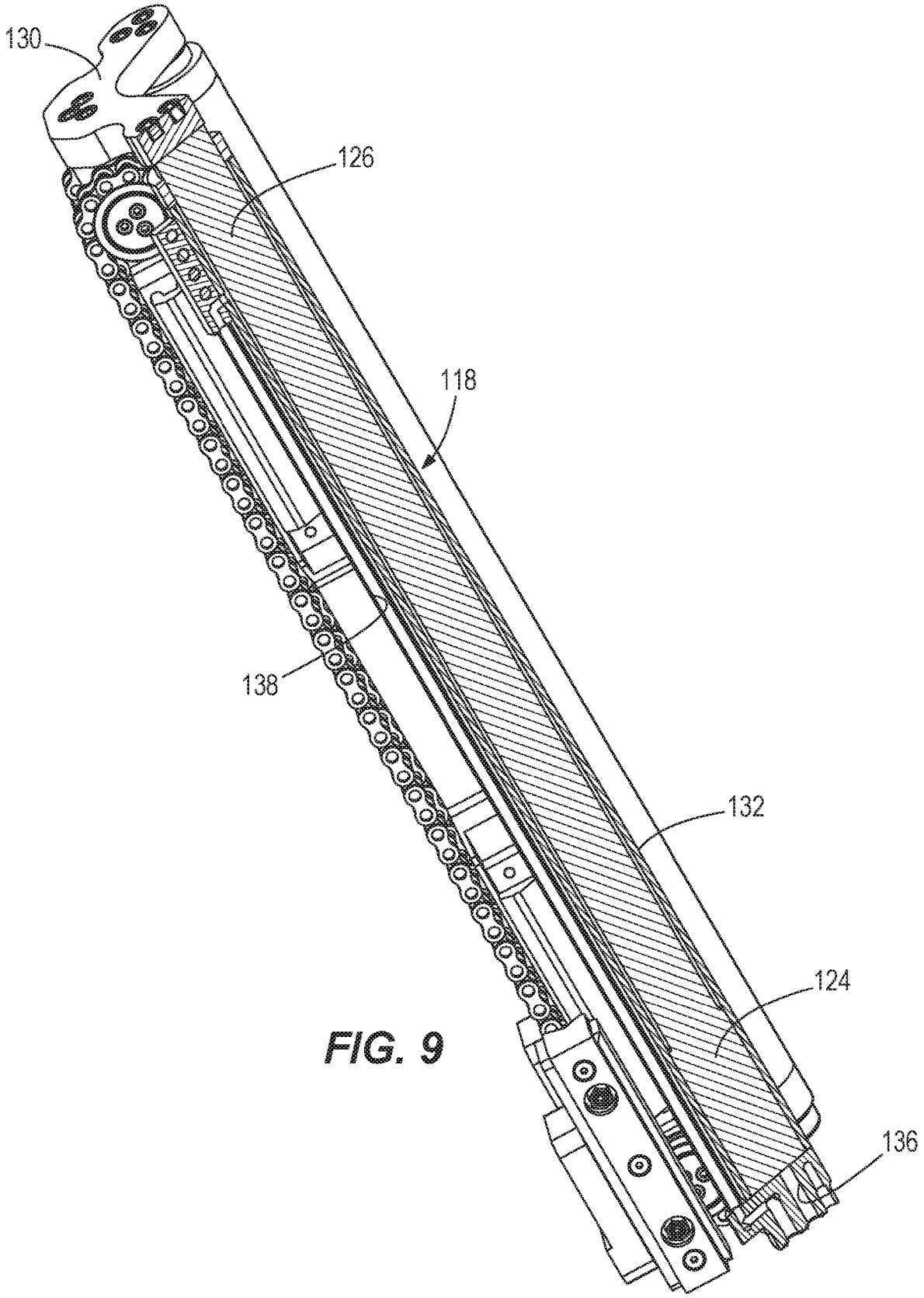
FIG. 9 is a section view of the feed device of FIG. 8, viewed along section 9-9.

As shown in FIG. 9, each yoke actuator 118 includes a rod 126 slidably received within a sleeve or barrel 132 secured to the lower feed block 74. A proximal end of each rod 126 is coupled to a piston 124 positioned within the barrel 132, and a distal end of each rod 126 is secured to the upper plate 130 of the yoke 114. In the illustrated embodiment, the yoke actuators 118 are oriented parallel to the base members 46 (i.e., the rods 126 extend from the barrels 132 in the same direction as the rods 54 of the base members 46, and in an opposite direction compared to the rod 86 of the feed frame actuator 82).

Each yoke actuator 118 includes a first fluid passage 136 in fluid communication with a portion of the barrel 132 adjacent a cap side of the piston 124, and a second fluid passage 138 in fluid communication with a portion of the barrel 130 adjacent a rod side of the piston 124. In the illustrated embodiment, the first fluid passage 136 of the yoke actuator 118 is in fluid communication with the barrel 132 adjacent the lower feed block 74 (FIG. 6), and the second fluid passage 138 extends along a length of the barrel 132 and is in fluid communication with an opposite end of the barrel 132. In the illustrated embodiment, both the first fluid passage 136 and the second fluid passage 138 of the yoke actuator 118 receive pressurized fluid through the lower feed block 74 (FIG. 6). Also, the transfer tubes 128 can convey pressurized fluid between the upper feed block 70 and the lower feed block 74.

Extension and retraction of the yoke actuators 118 moves the yoke 114, the drive member 122, the carriage 126, and the rotation unit in a direction parallel to the feed axis 30 (FIG. 3). Full extension of the yoke actuators 118 positions the upper plate 130 proximate the upper feed block 70. As shown in FIG. 8, in the illustrated embodiment, the drive member 122 includes a pair of flexible transmission members (e.g., chains 140) oriented parallel to one another and supported on the body 134. The chains 140 extend between a pair of spindles 142. In the illustrated embodiment, the spindles 142 are freely-rotatable.

Figure 10:
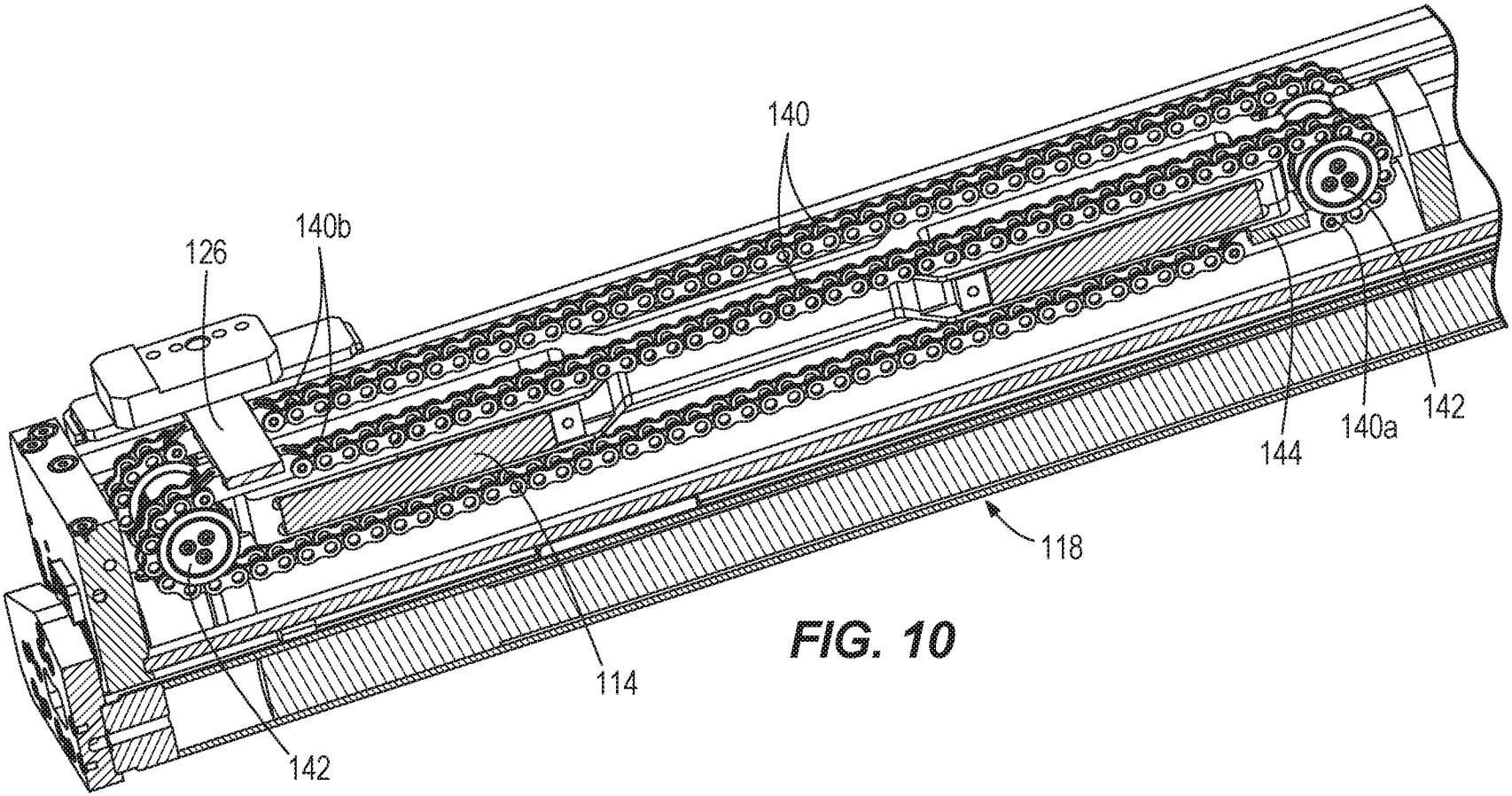
FIG. 10 is a section view of the drill device of FIG. 3, viewed along section 10-10.

As shown in FIG. 10, one end 140*a* of each chain 140 is coupled to a block 144 that is connected to the frame 26, and an opposite end 140*b* of each chain 140 is coupled to the carriage 126. As the yoke actuators 118 move the yoke 114 along feed axis 30, the chains 140 which are fixed to the frame 26 via the block 144, cause the carriage 126 to move along the feed axis 30. When the yoke actuators 118 are extended, the carriage 126 moves toward the upper feed block 70 (FIG. 3); when the yoke actuators 118 are retracted, the carriage 126 moves away from the upper feed block 70. In some embodiments, the carriage 126 moves twice as fast as the actuators 118 (that is, a ratio that the carriage 126 moves relative to a length of extension or retraction of the yoke actuators 118 is 2:1).

Referring again to FIG. 7, the body 134 includes a pair of inner guide members or inner guide shoes 148*a*, 148*b* engaging the inner grooves 102*a*, 102*b* of the guide bars 78, and the carriage 126 includes a pair of outer guide members or outer guide shoes 152*a*, 152*b* engaging the outer grooves 106*a*, 106*b* of the guide bars 78. In the illustrated embodiment, each of the inner guide shoes 148*a*, 148*b* has a convex wedged or tapered shape having an apex 158*a*, 158*b*, respectively, positioned in a root of the associated inner groove 102*a*, 102*b*. Also, in the illustrated embodiment, each of the outer guide shoes 152*a*, 152*b* forms a concave wedges or tapered shape engaging an outer surface of one of the guide bars 78. Each outer guide shoe 152*a*, 152*b* includes a root 160*a*, 160*b*, respectively, receiving an edge of the guide bar 78. In other embodiments, the outer guide shoes 152*a*, 152*b* could be formed to engage outer surfaces of both guide bars 78 in each pair. The apices 158*a*, 158*b* of the inner guide shoes 148*a*, 148*b* are aligned in a first plane 170, and the roots 160*a*, 160*b* of the outer guide shoes 152*a*, 152*b* are aligned in a second plane 174.

Figure 11:
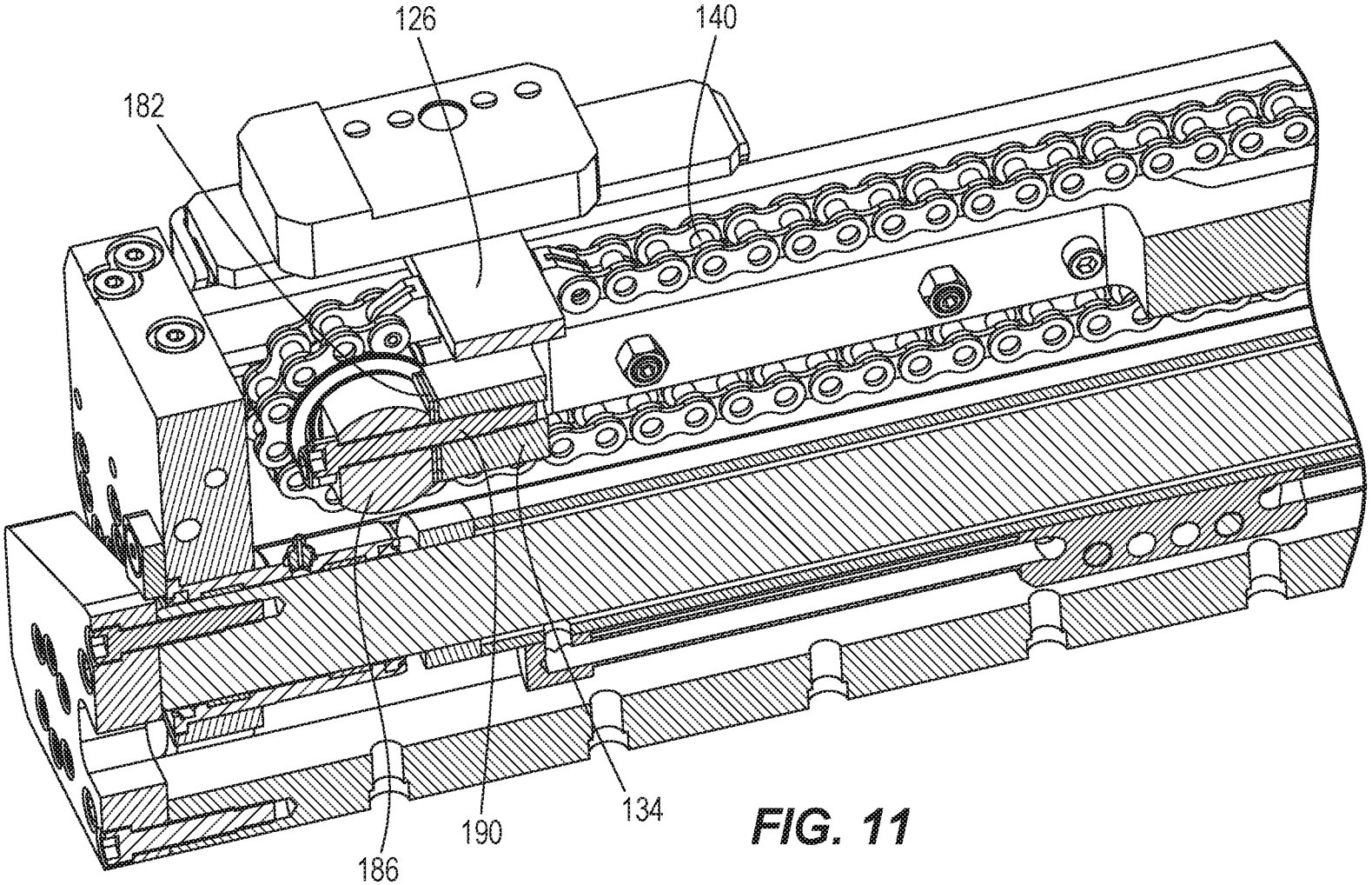
FIG. 11 is an enlarged section view of a portion of the drill device of FIG. 3, viewed along section 5-5.
Figure 12:
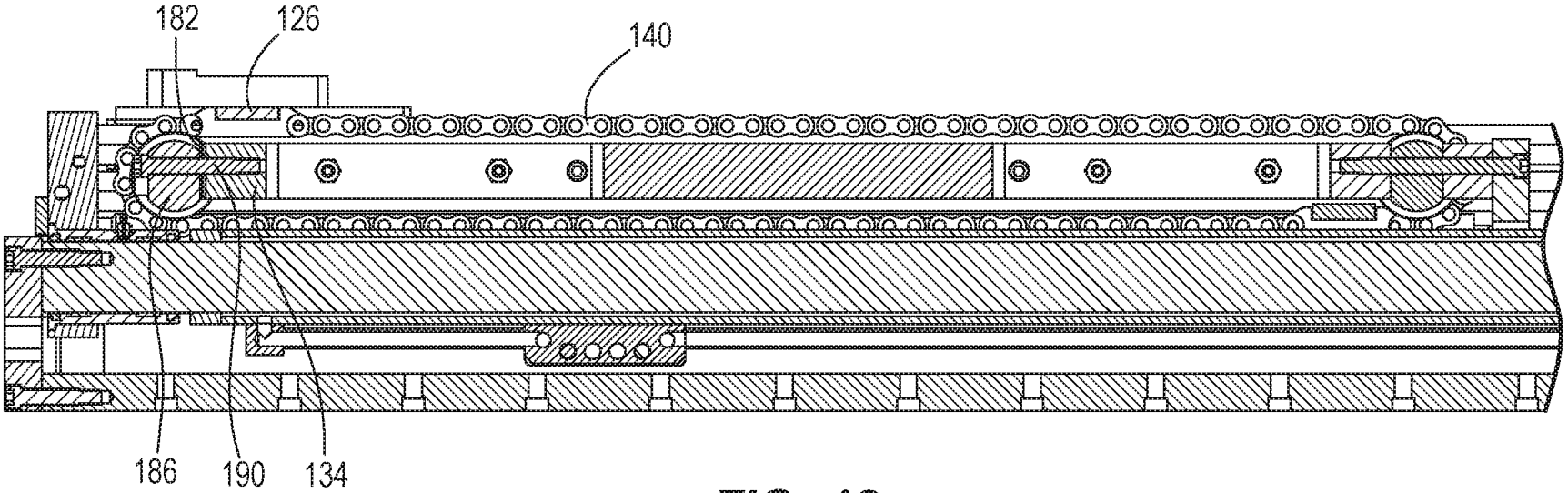
FIG. 12 is an enlarged side section view of a portion of the drill device of FIG. 3, viewed along section 5-5.

Referring now to FIGS. 11 and 12, one or more shims 182 can be positioned adjacent one of the spindles 142. In particular, in the illustrated embodiment, a non-rotating portion or body 186 of the spindle 142 is coupled to an end of the body 134 of the yoke 114 (for example, by a fastener 190). As the chains 140 wear and/or stretch, slack may develop in the chains 140. The shims 182 can be positioned between the spindle 142 and the yoke 114 to increase a length between the spindles 142, thereby taking up the slack. In some embodiments, shims 182 can be added adjacent one or both of the spindles 142.

Although various aspects have been described in detail with reference to certain preferred embodiments, variations and modifications exist within the scope and spirit of one or more independent aspects as described. Various features and advantages are set forth in the following claims.

What is claimed is:

1. A drill device comprising:

a base frame including a pair of fluid cylinders;

a feed frame supported for movement relative to the base frame, the feed frame extending along a feed axis and including a plurality of guide bars aligned parallel to the feed axis; and a feed device for inserting a drill element into a rock surface, the feed device supported for movement relative to the feed frame in a direction parallel to the feed axis, the feed device including a first guide member and a second guide member positioned on opposite sides of the feed axis relative to one another, the first guide member engaging a surface of at least one of the guide bars, the second guide member engaging another surface of at least one of the guide bars, the first guide member having a concave shape and including a first root receiving a first edge of at least one of the guide bars, the second guide member having a concave shape and including a second root receiving a second edge of at least one of the guide bars.

2. The drill device of claim 1, wherein the feed device includes a yoke movable relative to the feed frame and a carriage movable relative to the yoke and supporting a rotation unit, wherein the guide bars engage and guide both the yoke and the carriage.

3. The drill device of claim 2, wherein the feed frame includes an upper feed block and a lower feed block between which the plurality of guide bars extend.

4. The drill device of claim 3, wherein the plurality of guide bars includes a first pair of guide bars positioned on one side of the feed frame and a second pair of guide bars positioned on another side of the feed frame.

5. The drill device of claim 3, wherein the yoke includes an upper plate and yoke actuators coupled between the upper plate and the lower feed block.

6. The drill device of claim 1, wherein each of the guide bars has a polygonal cross-section profile.

7. The drill device of claim 1, wherein each of the guide bars has a hexagonal cross-section profile.

8. The drill device of claim 1, further comprising a third guide member having a convex shape and including an apex positioned in a root that is formed by at least one of the guide bars.

9. The drill device of claim 1, further comprising a third guide member having a convex shape and including a first apex positioned in a first root that is formed by at least one of the guide bars, and a fourth guide member having a convex shape and including a second apex positioned in a second root that is formed by at least one of the guide bars.

10. The drill device of claim 1, wherein the first guide member and the second guide member are outer guide members, further comprising a pair of inner guide members positioned on opposite sides of the feed axis from one another, each of the inner guide members having a convex shape and including an apex positioned in a root that is formed by at least one of the guide bars, wherein the apices of the inner guide members are positioned in a first plane and the roots of the outer guide members are positioned in a second plane offset from the first plane.

11. A drill device comprising:

a base frame including a pair of fluid cylinders;

a feed frame supported for movement relative to the base frame; and a feed device supported on the feed frame, the feed device including a yoke, a spindle supported on the yoke, and a flexible transmission member engaging the spindle, the spindle being releasably coupled to the yoke to permit at least one shim to be positioned between the spindle and the yoke, thereby adjusting a tension of the flexible transmission member.

12. The drill device of claim 11, wherein the feed device further includes a carriage, and wherein a first end of the flexible transmission member is coupled to a block connected to the feed frame, and an opposite end of the flexible transmission member is coupled to the carriage.

13. The drill device of claim 12, wherein the yoke includes a body supporting a drive member, and wherein the spindle includes a non-rotating portion that is coupled to the body of the yoke.

14. A drill device comprising:

a base frame including a pair of fluid cylinders;

a feed frame supported for movement relative to the base frame; and a feed actuator including a first end coupled to the base frame and a second end coupled to the feed frame, the feed actuator being extendable and retractable to move the feed frame relative to the base frame, the feed actuator having an identical height and width as the fluid cylinders of the base frame, the feed actuator positioned in an opposite orientation relative to the fluid cylinders of the base frame.

15. The drill device of claim 14, wherein at least one of the feed actuator and the fluid cylinders includes a first passage for providing pressurized fluid to one side of a piston, a second passage for providing pressurized fluid to an opposite side of the piston, and a manifold receiving pressurized fluid from a fluid source, the manifold providing fluid to each of the first passage and the second passage.

16. The drill device of claim 14, wherein at least one of the feed actuator and the fluid cylinders includes a first passage for providing pressurized fluid to one side of a piston, a second passage for providing pressurized fluid to an opposite side of the piston, and a manifold providing fluid communication between a first portion of the first passage and a second portion of the first passage.

17. The drill device of claim 14, wherein the base frame includes a lower plate and a connecting plate between which the fluid cylinders extend.

18. The drill device of claim 17, wherein the fluid cylinders each include a rod and a barrel, the rod including a proximal end and a distal end, the proximal end coupled to a piston slidably positioned within the barrel, the distal end secured to the connecting plate, the barrel secured to the lower block.

* * * * *